US008607875B2

(12) United States Patent
Ringgenberg et al.

(10) Patent No.: US 8,607,875 B2
(45) Date of Patent: Dec. 17, 2013

(54) ROTATIONAL WELLBORE TEST VALVE

(75) Inventors: Paul David Ringgenberg, Frisco, TX (US); Charles Frederick Carder, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 275 days.

(21) Appl. No.: 13/007,168

(22) Filed: Jan. 14, 2011

(65) Prior Publication Data

US 2012/0181018 A1 Jul. 19, 2012

(51) Int. Cl.
*E21B 43/00* (2006.01)

(52) U.S. Cl.
USPC ..... 166/330; 166/373; 251/345; 251/352

(58) Field of Classification Search
USPC ..... 166/373, 250.01, 387, 330, 332.2, 166/334.2; 251/229, 352, 343, 304; 137/155
See application file for complete search history.

(56) References Cited

U.S. PATENT DOCUMENTS 4,722,400 A * 2/1988 Burns ..... 166/330
6,474,419 B2 11/2002 Maier et al.

* cited by examiner

*Primary Examiner* — Yong-Suk (Philip) Ro
(74) *Attorney, Agent, or Firm* — Booth Albanesi Schroeder LLC

(57) ABSTRACT

According to one embodiment, a rotationally activated downhole well valve for connection in a tubing string is disclosed that can be repeatedly opened and closed selectively to place the tubing string in communication with the annulus. The valve is moved between the closed position and the open position by rotating the string in the first direction.

10 Claims, 8 Drawing Sheets

ROTATIONAL WELLBORE TEST VALVE

BACKGROUND

Technical Field

The invention relates generally to an apparatus for use in testing a hydrocarbon well and, more particularly, to an apparatus for conducting testing of hydrocarbon bearing subterranean formations, such as injection fall off and drawdown testing.

SUMMARY OF THE INVENTION

One method of testing subterranean hydrocarbon wells involves isolating a segment of the wellbore and subjecting that segment to pressure testing. In one example, pressure buildup in the segment is measured over time. In another example, pressure in the segment is raised and its fall off over time is measured. Typically, the well segment to be tested is isolated by a pair of spaced packers positioned in the well on a test tubing string. A valve is assembled in the tubing string between the packers, and during testing, the valve is opened and closed to provide flow between the interior of the test tubing string and the wellbore section being tested. Transducers are also present in the assembly to measure pressure and other conditions in the segment during the test. The testing procedure involves positioning the test tubing string at the wellbore segment to be tested and then setting the packers to isolate a segment of the wellbore for testing or treatment. In operation, the packers are set and the valve is operated to perform pressure tests on the wellbore segment. Thereafter, the packers are unset, the testing string is moved to isolate a different wellbore segment, and the test process is repeated. Accordingly, there is a need for a valve that can be operated (opened and closed) repeatedly and reliably.

The present invention provides a valve for connection to a test tubing string and a method for using the valve to selectively connect the interior of the tubing string to the annulus. The valve can be repeatedly actuated (either opened or closed) by rotating the tubing string in one direction (right-hand rotation).

As used herein, the words "comprise," "have," "include," and all grammatical variations thereof are each intended to have an open, non-limiting meaning that does not exclude additional elements or steps. The terms "up" and "down" are used herein to refer to the directions along the wellbore toward and away from the wellhead and not to gravitational directions. The term "tubing string" is used herein to refer to coil tubing, tubing, drill pipe or other tool deployment strings.

BRIEF DESCRIPTION OF THE DRAWINGS

The drawings together with the written description, serve to explain the principles of the invention. The drawings are only for the purpose of illustrating at least one preferred example of at least one embodiment of the invention and are not to be construed as limiting the invention to only the illustrated and described example or examples. The various inherent advantages and features of the various embodiments of the present invention are apparent from a consideration of the drawings in which.

DETAILED DESCRIPTION OF THE INVENTION

Figure 1:
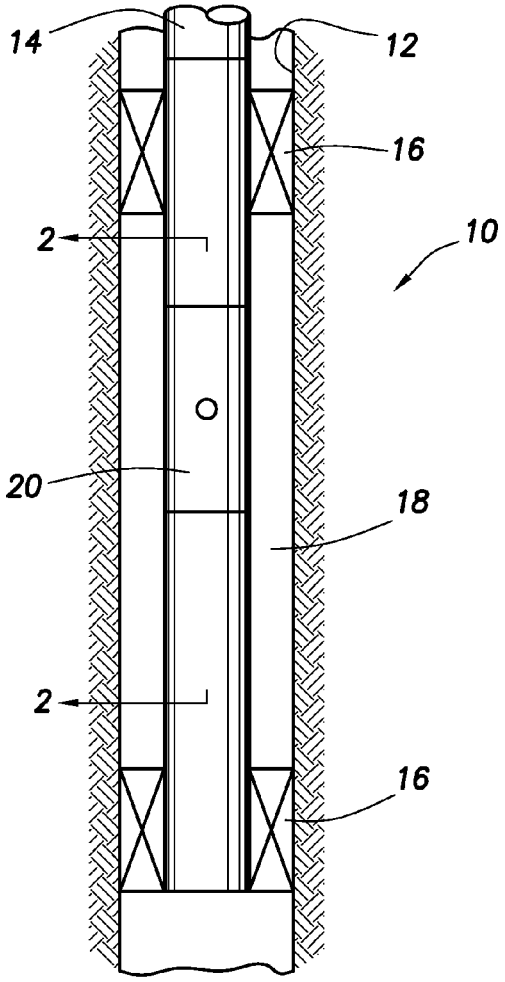
FIG. 1 is a partial, longitudinal section view of a tubing string positioned to isolate a segment of a wellbore for testing or treatment.

Referring now to the drawings wherein like reference characters designate like or corresponding parts throughout the several views, there is shown in FIG. 1 the valve assembly 10 of the present invention. The valve assembly 10 is illustrated positioned downhole in the wellbore 12 on tubing string 14 extending from the wellhead. The valve assembly 10 is utilized downhole in a wellbore to isolate a segment of annulus 18 surrounding valve assembly 10 and sealed off by the packers. A pair of wellbore packers 16 is mounted on tubing string 14. As is well known in the industry, these packers can be set and unset to isolate a segment of annulus 18. For example, packers 16 can be of the Type II weight down or compression packer-type described in E. E. Smart's July, 1978 article entitled "How To Select The Right Packer For the Job" in *Petroleum Engineering International*. The packers 16 can be rotatably mounted on tubing string 14.

The valve assembly 10 contains a valve 20 that can be opened and closed by rotation of tubing string 14 in a single direction. For purposes of describing these inventions, clockwise rotation of the tubing string will be used as an example because it is typical in well equipment. Clockwise rotation will open a port in valve 20 and place tubing string 14 in fluid communication with annulus 18. Pressure apparatus (not shown) can measure fluid pressure changes in the isolated segment of annulus 18.

An example of a method of using valve assembly 10 of the present invention comprises: connecting valve assembly 10 in a tubing string 14, lowering the valve into a wellbore to a subterranean location; activating packers 16 to isolate a portion or segment of the wellbore, rotating tubing string 14 clockwise to open valve 20; tubing string rotation is discontinued, pressure in the segment is raised; the tubing string is again rotated clockwise to close the valve, tubing string rotation is discontinued and pressure of the fluid in annulus 18 be measured over time. Upon completion of the measuring step, the packers 16 are unset; and thereafter, tubing string 14 is moved (raised and/or lowered) to a different location and the process is repeated without removing tubing string 14 from the wellbore.

Figure 2A:
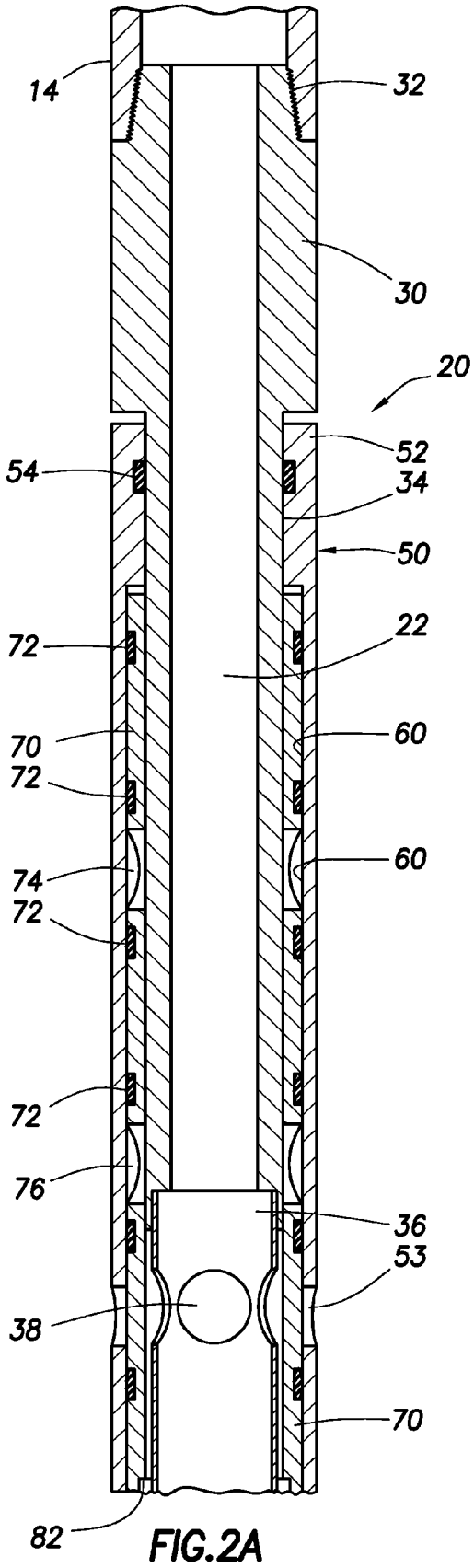
FIG. 2A-C represents a longitudinal section view taken on line 2-2 of FIG. 1, taken in the direction of the arrows, illustrating an embodiment of the valve of the present invention with the packers removed for simplicity of description.
Figure 2B:
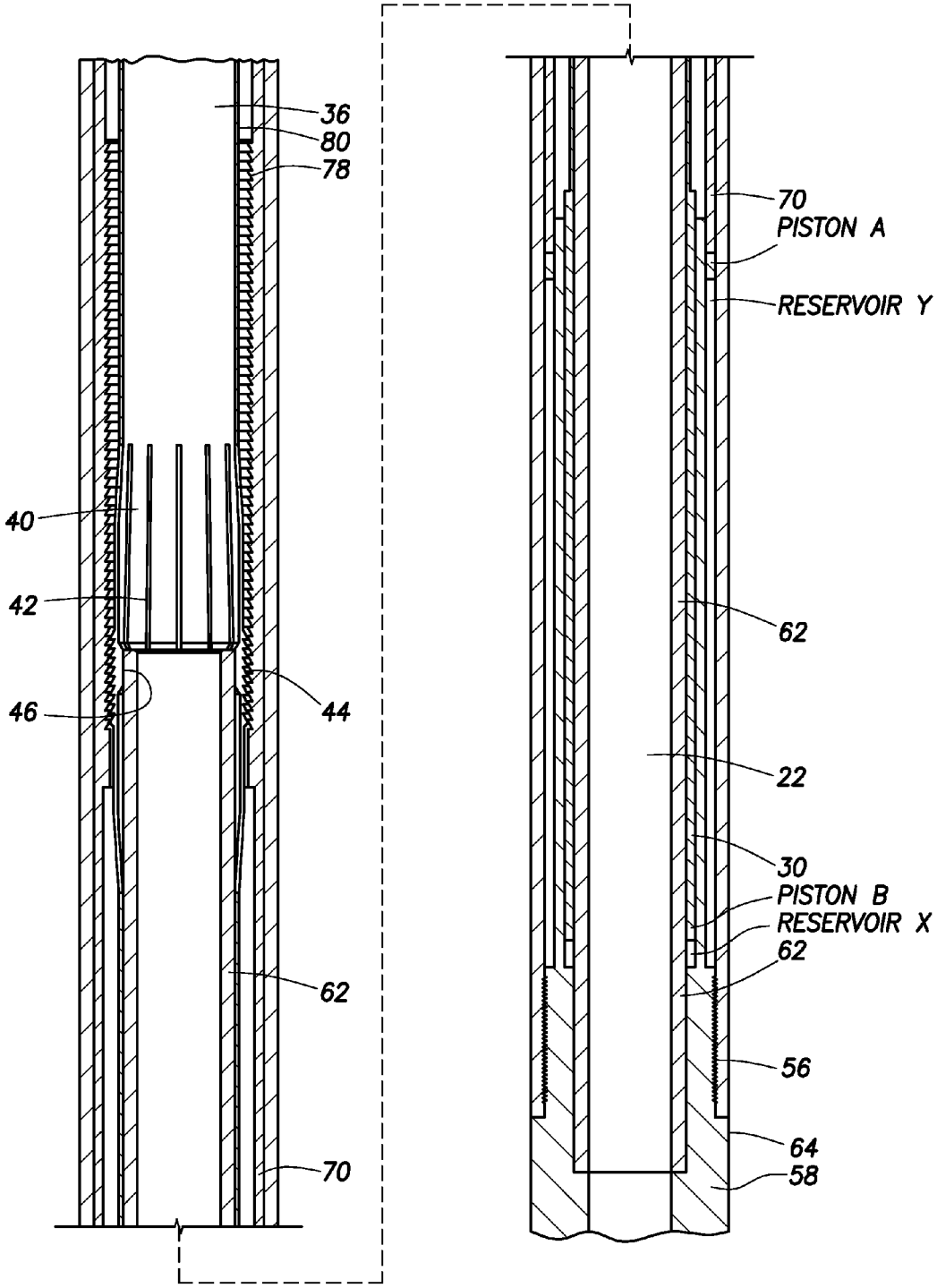
Figure 2C:
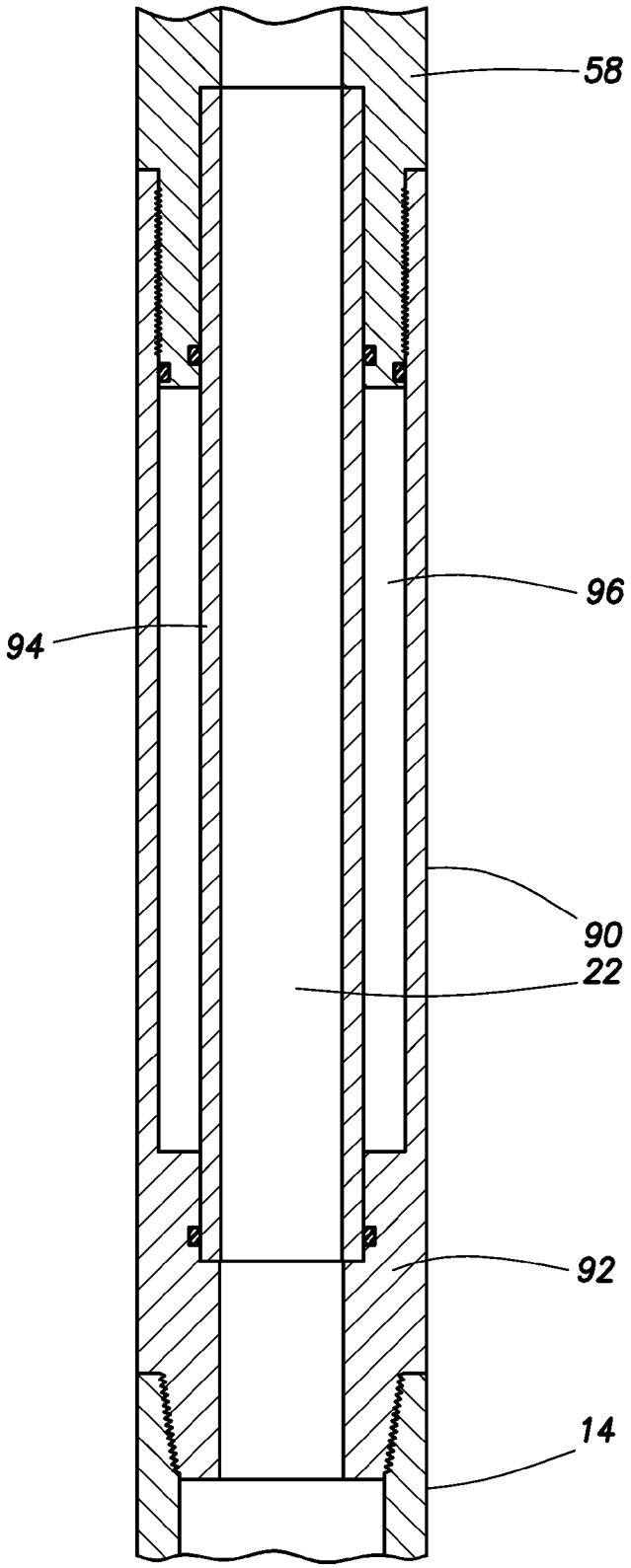

One embodiment of valve 20 included in valve assembly 10 is illustrated in FIGS. 2A-C as having a central passageway 22 extending there through and in communication with the tubing string 14. The valve 20 is illustrated in the closed position and comprises four major subparts. These major subparts comprise: member 30, upper housing 50, valve element 70, and lower housing assembly 90.

Tubular-shaped member 30 is located on the wellhead side of valve 20 and is coupled to tubing string 14 by a threaded connection 32. The member 30 has a reduced diameter portion 34 that telescopes into open upper end 52 of upper housing 50. A seal 54 in the upper housing 50 seals around reduced diameter portion 34 leaving it free to rotate and longitudinally translate with respect to upper housing 50. Tubular valve actuator 36 is connected to the lower end of member 30. The lower end of valve actuator 36 forms a piston B to reciprocate in annular hydraulic chamber X. Tubular valve actuator 36 has four circumferentially-spaced ports 38 formed adjacent to its connection to member 30. Axially extending collet fingers 40 are formed on valve actuator 36 and are separated by a plurality of longitudinally extending slots 42. Teeth 44 are formed on the exterior of collet fingers 40. Each of the collet fingers 40 has cam surface 46 formed on the interior thereof.

Upper housing 50 is tubular shaped and forms a chamber 60 therein. Ports 53 are formed in the wall of upper housing 50 and are aligned to be longitudinally adjacent to ports 38 in valve actuator 36 when the tool is in the position illustrated in FIG. 2. A union 58 is threaded into end 56 of upper housing 50. A tubular member 62 is mounted in union 58 and extends upward into the lower end of valve actuator 36 and, when in the position illustrated in FIG. 2, engages the cam surfaces 46 to spread collet fingers 40 radially outward.

Valve element 70 is tubular shaped and is mounted in chamber 60 to slide axially within chamber 60. Valve element 70 includes a plurality of annular seals 72 which provide sliding sealing engagement with the interior wall of upper housing 50. An annular chamber is formed below valve element 70 for hydraulic fluid. The lower end valve element 70 acts as a piston A in chamber Y. In this embodiment, two sets of axially spaced ports, 74 and 76, extend through the wall of the valve element 70. It should be appreciated that the valve element 70 could have one or even more than two ports as desired. Threads 78 are formed on the interior of the lower end of valve element 70. Annular slot 80 is formed in the interior wall of valve element 70. Slot 80 is bound on its upper end by downward-facing shoulder 82.

Lower housing assembly 90 is tubular shaped with one end threaded into union 58. Lower housing assembly 90 is threaded at 92 for connection to tubing extending below valve 20. A sleeve 94 is mounted in lower housing assembly 90 to provide a flow path through valve 20 and forms internal annulus 96. Annulus 96 is closed at both ends and functions as a hydraulic fluid reservoir. Union 58 has internal ports (not shown) that the hydraulic fluid travels through to reset the valve.

To open and close valve 20; tubing string 14 is rotated in a clockwise direction which, in turn, rotates member 30. In FIGS. 2A-C, the valve element 20 is in the closed position with both ports 74 and 76 axially spaced from the ports 53 and 38. With the valve 20 in this closed position shown in FIGS. 2A-C, collet fingers 40 are forced outward by tubular member 62 whereby teeth 44 are forced into engagement with threads 78 on valve element 70. As member 30 rotates, teeth 44 will engage threads 78 and cause valve element 70 to move in a downward direction, away from upper end 52. As will be appreciated, a set number of rotations will open valve 20 by causing ports 76 to move downward into alignment with ports 38 and 53. This connects the annulus 18 to the interior of the tubing string. the Additional rotations will close valve 20 by moving parts 76 out of alignment with ports 38 and 53. A further set number of rotations will open valve element 20 by aligning ports 74 with ports 38 and 53. With either port 74 or 76 aligned with ports 38 and 53, the valve interior 22 is open to the annulus 18. Upon continued rotation, the valve element 70 will move downward until teeth 44 engage slot 80 as ports 74 are closed. Downward movement of valve element 70 will cause piston A to pump hydraulic fluid from chamber Y. Ports 74 will remain closed until the valve is reset without regard to additional rotations. Once the teeth 44 are in the slot 80, further and continued rotation of the drill string and actuator will cause no additional movement of the valve element 70.

To reset the valve 20, tubing string 14 is raised and then lowered while the packers 16 are in the set position. This restrains upper housing 50, union 58 and lower housing assembly 90 against movement in the wellbore. Lifting of the string causes the valve actuator 36 to telescope axially upward with respect to upper housing 50 with the lower end of actuator 36 acting as a piston B in annular chamber X. During this movement, teeth 44 are disengaged and allow valve actuator 36 to move upward without contacting valve element 70. The upward movement pumps hydraulic fluid from the annulus 96 through a port in union 58 and into chamber X. A valve (not shown) controls hydraulic fluid flow through a port (not shown), connecting chambers X and Y and annulus 96. When the piston B is in the lowest position, shown in FIG. 2*b*, the valve opens, permitting hydraulic fluid flow between chambers X and Y and annulus 96. When the piston B on valve actuator 36 moves out of the lowest position, the valve acts as a check valve, permitting fluid flow from annulus 96 into chambers X and Y while blocking flow from chambers X and Y into annulus 96. As previously explained, upward movement of the tubing string does not affect the position of the valve, leaving the valve in its last position.

Subsequently, when the tubing string is lowered, valve actuator 36 will move down, with piston B pumping fluid from the chamber X to chamber Y, which in turn causes valve element 70 to telescope into the upper housing 50 to the position shown in FIG. 2A-C. It should be appreciated that as the valve element 70 moves upward, teeth 44 are not extended radially into contact with threads 78. Teeth 44 do not reengage these threads until cam surface 46 on the collet fingers 40 engage tubular member 62 to spread the collets outward. By resetting the valve 20, the process of opening and closing can be repeated as many times as desired without unsetting the packers. In addition, the packers can be unset, moved and set to isolate a different section of the wellbore; and the valve can be opened and closed to test the wellbore section.

The features of an alternative configuration, downhole valve assembly 110, are illustrated in FIGS. 3 and 4A-D. The valve assembly can be used in the configuration illustrated in FIG. 1 with spaced packers isolating a wellbore segment. In this embodiment, the valve moves between the open and closed positions by rotating the tubing string a minimum number of revolutions without lifting and lowering the string to reset the valve. For example, if the valve is in the closed position, a minimum number of revolutions of the tubing string in the clockwise direction causes the means for moving the valve to move the valve to the open position and a means for maintaining causes the valve to remain in the open position while rotation continues beyond the minimum number of rotations. The valve will be maintained in the open position after rotation ceases. To close the open valve, a minimum number of revolutions of the tubing string in the clockwise direction moves the valve to the closed position and maintains it in the closed position while rotation continues. The valve will remain in the closed position even after rotation ceases. The process of opening and closing the valve can be repeated, as many times as desired, merely by rotating the tubing string in one direction. Due to the presence of slack, drag, flexure and other factors, rotation of the tubing string by the rig at the wellhead is not necessarily transmitted to the valve at a downhole location. Accordingly, valves that function based on a set amount of rotation are not reliable. The present valve solves that problem by maintaining the valve in position after it has changed position while rotation continues. The present valve is designed to move from one position to another upon the application of at least a set minimum number of revolutions of the tubing string. If the valve is designed to open and/or close after the application of ten (10) revolutions, the operator will exceed that minimum number and rotate the tubing string, for example, twenty (20) revolutions or even more. In this method, the rig operator can be assured that the minimum has been exceeded and the valve actuated. Once the minimum has been reached, the means for maintaining holds the valve in its actuated position.

Figure 3:
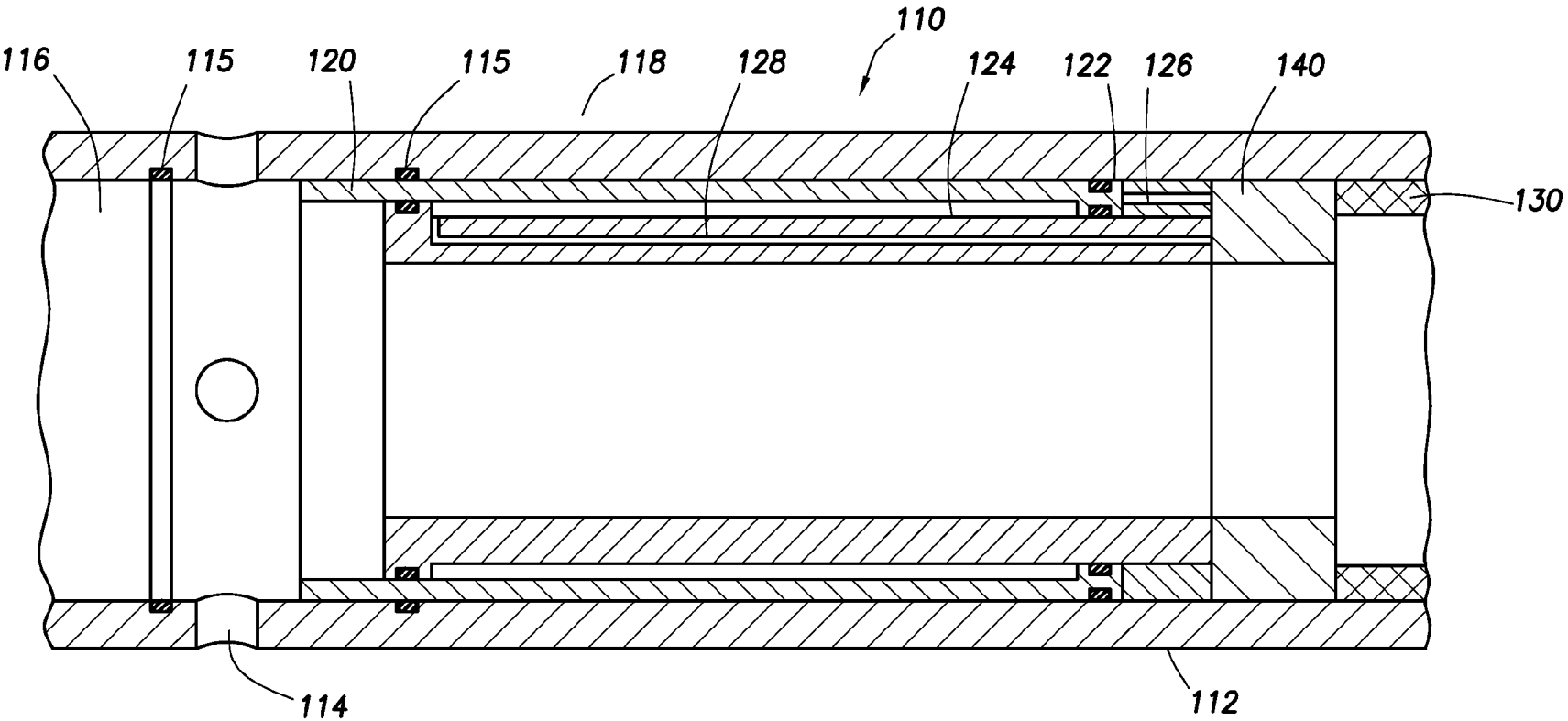
FIG. 3 is a longitudinal section view, similar to FIG. 2, illustrating another embodiment of the valve of the present invention.

In the FIG. 3 embodiment, valve assembly 110 is configured as a sliding sleeve-type valve. Valve assembly 110 comprises housing 112, which can be set in the well as illustrated in FIG. 1. Ports 114 extend through the wall of the housing 112 and connect the interior of housing 116 with the annulus 118. Seals or packing 115 isolate the ports 114. An annular valve element 120 is located within housing 112 to axially move within housing 112 to engage seals 115 and block flow through ports 114. An annular double acting piston 122 is mounted to move axially in annular chamber 124. Piston 122 is connected valve element 120. Fluid passageways 126 and 128 are in fluid communication with chamber 124. These passageways are used to create a pressure differential across piston 122 which causes valve element 120 to move between the open and closed positions.

Actuator sleeve 130 is connected to rotate with the tubing string (not shown) while the housing 112 is held in place in the well by packers (see FIG. 1). A fluid pump assembly 140 is mounted in housing 112 and is connected to actuator sleeve 130. Pump assembly 140 contains suitable fluid components, such that when the tubing string is rotated, pressurized fluids are provided to chamber 124 to move piston 122 and the valve element. The pump comprises the actuator.

The details of pump assembly 140 and its methods of operation will be described by reference to FIGS. 4A-D. A rotary fluid pump 142 is connected to actuator 130, and when the actuator sleeve 130 rotates pump 142, fluid is pumped from reservoir R. The output 144 of rotary pump 142 is connected to a normally closed pressure relief valve 146. A flow restrictor 148 is connected between the suction side 150 of rotary pump 142 and valve pressure relief valve 146. Output 144 is also connected to port 152 of a rotary four port, two-position control valve 154. Port 156 is connected to reservoir R. Shifter 160 operates valve 154.

Figure 4A:
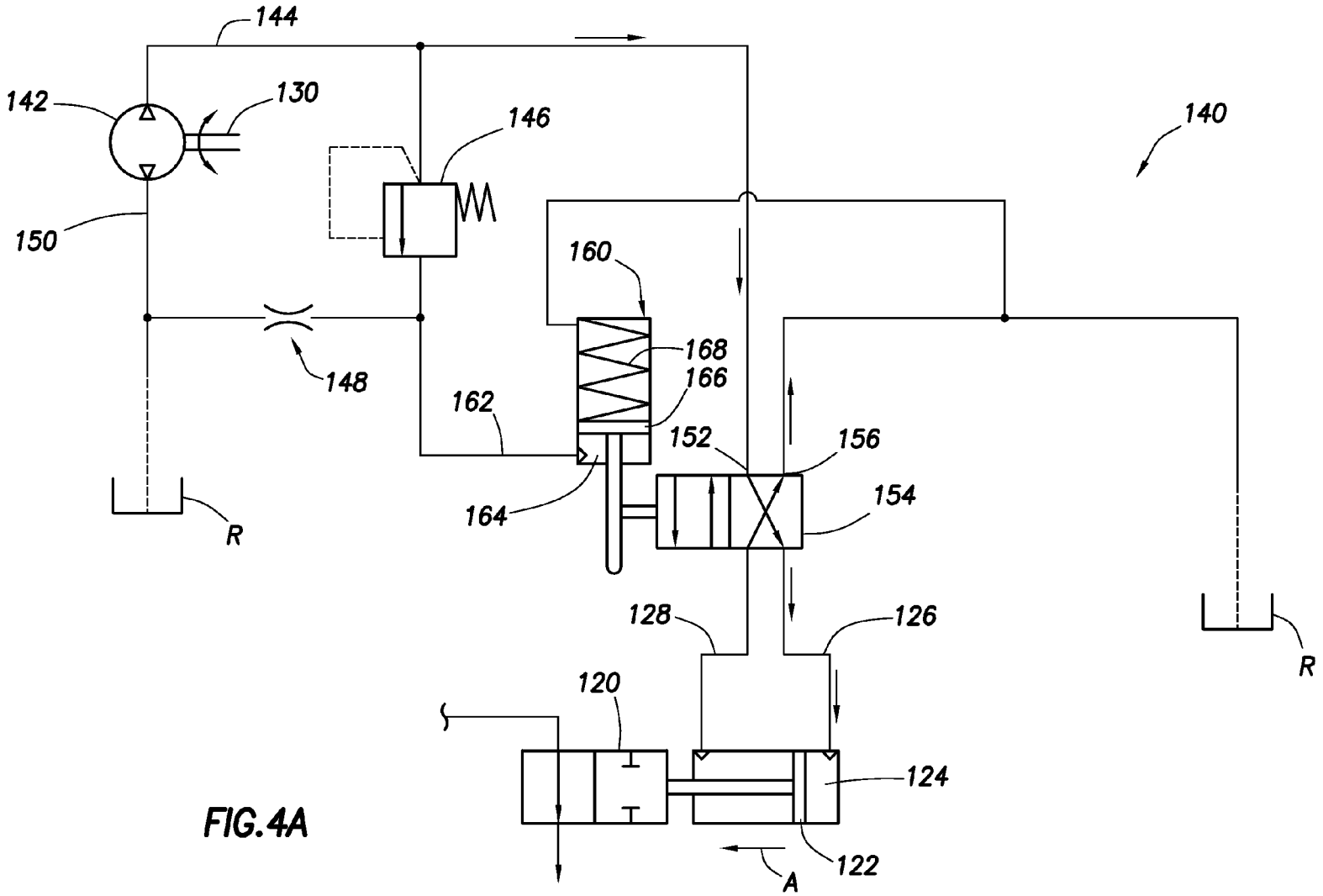
FIG. 4A-D are schematic diagrams of the embodiment illustrated in FIG. 3.

In FIG. 4A, valve element 120 is illustrated in the open position. To move the valve element 120 to the closed position, the tubing string and actuator sleeve 130 are rotated in the clockwise direction. As actuator sleeve 130 is rotated, pump 142 pumps fluid to port 152 on valve 154. As illustrated in FIG. 4A, port 152 is connected to fluid passageway 126 which allows fluid to be pumped into the chamber 124 to move the piston 122 and valve element 120 in the direction of arrow A to the closed position. As is illustrated, fluid ejected through fluid passageway 128 is returned to the reservoir via port 156 in valve 154. The pump, valve and piston comprise an actuator assembly for moving the valve element.

Figure 4B:
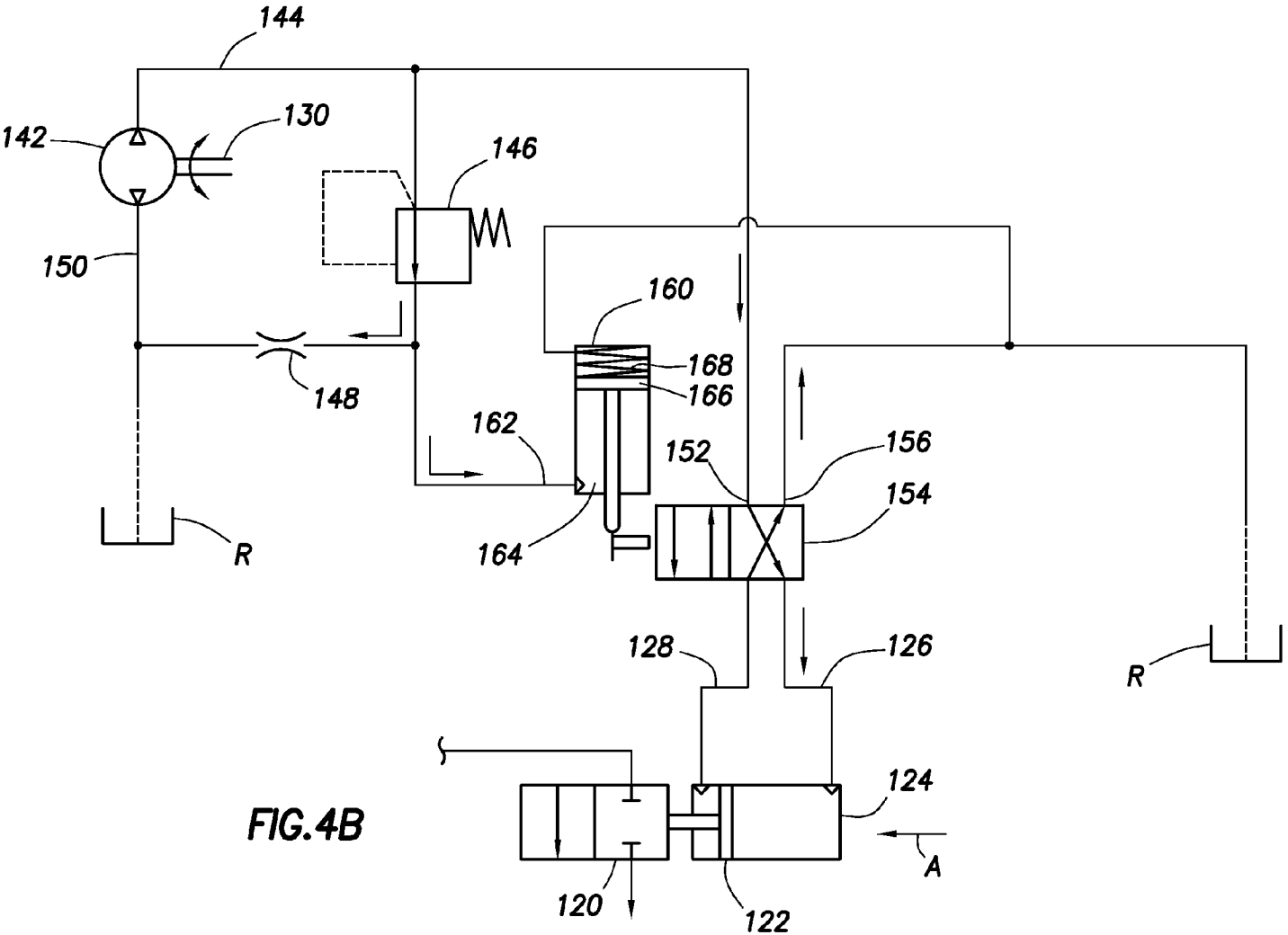

As the piston 122 bottoms out as illustrated in FIG. 4B, valve element 120 had been moved to the closed position, and the pressure of fluid in output 144 will increase, causing pressure relief valve 146 to open. Flow restrictor 148 causes pressurized fluid to back up through line 162 and into chamber 164 of shifter 160. Fluid pressure in chamber 164 will cause piston 166 to move and compress spring 168. As long as the tubing string continues to rotate the rotary pump 142, the piston 166 will remain in a position, compressing spring 168. Once tubing string rotation ceases and the pump 142 ceases to pump fluids, pressure in chamber 164 will decrease by bleeding off through flow restrictor 148, allowing the spring 168 to move the piston 166 to the position illustrated in FIG. 4C. As the piston 166 moves from the position illustrated in FIG. 4B to the position illustrated in FIG. 4C, shifter 160 shifts the valve 154 to the position illustrated in FIG. 4C. The valve element 120 will remain in the closed position illustrated in FIG. 4C until rotation of tubing string is started again.

Figure 4C:
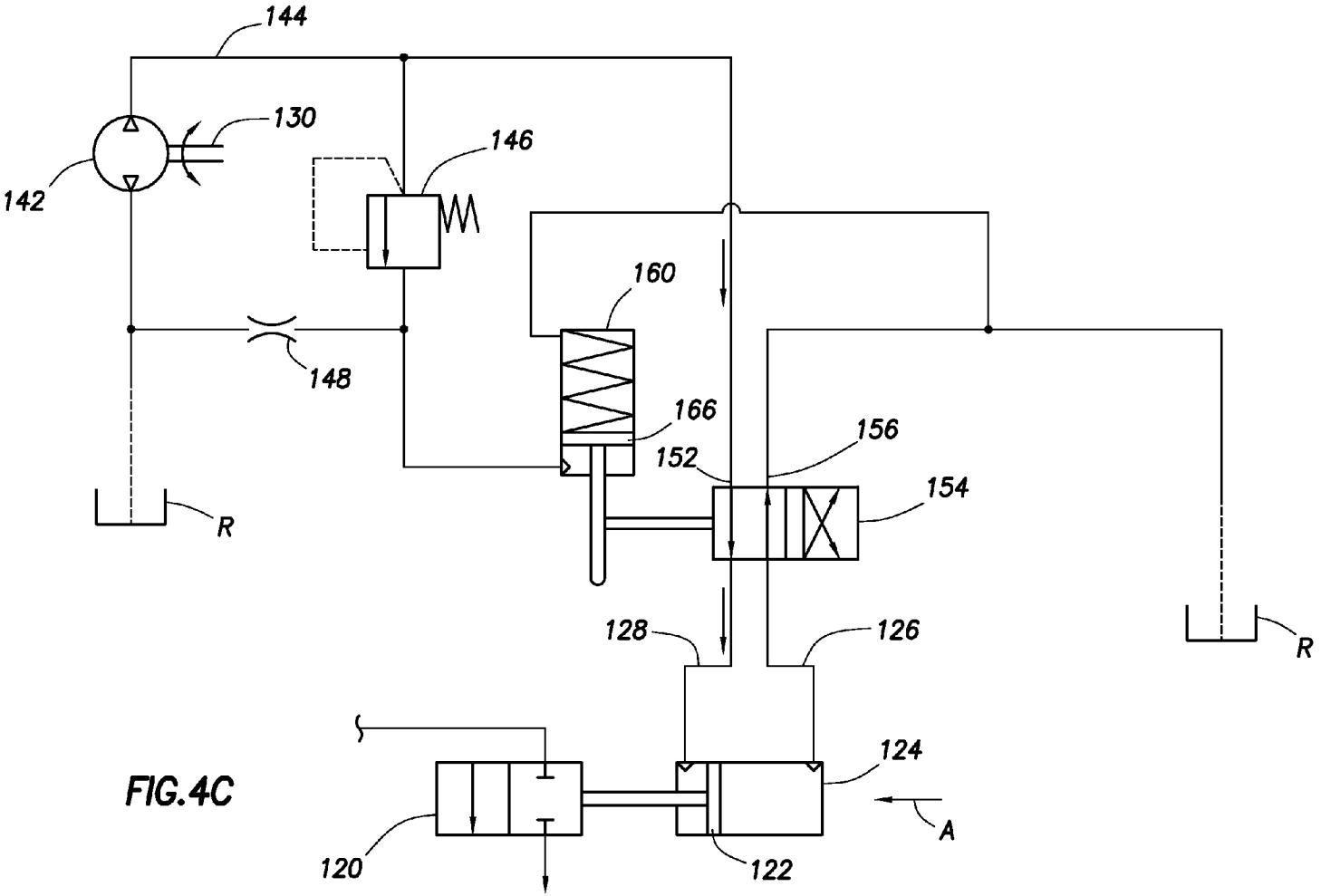
Figure 4D:
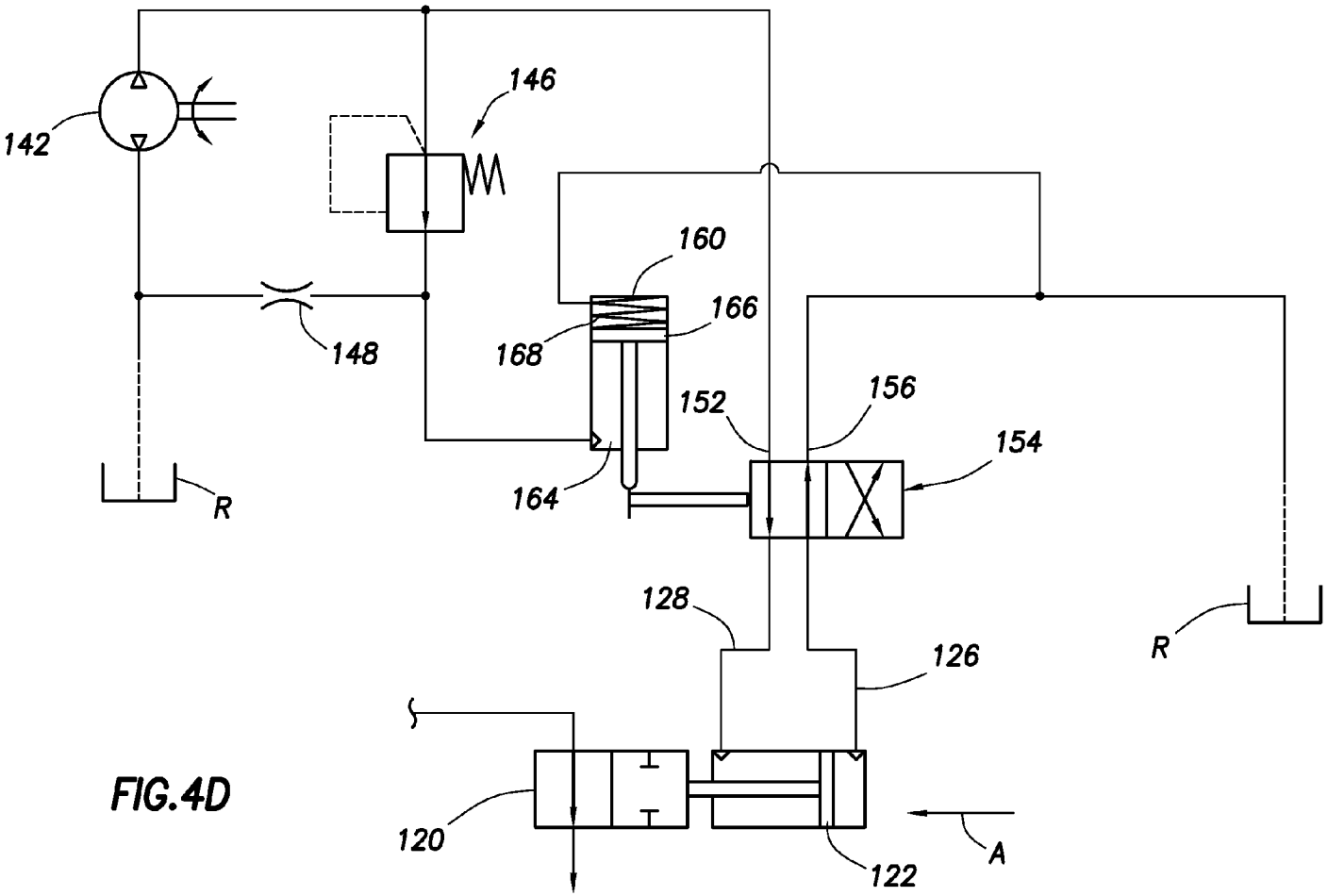

To return valve element 120 to the open position, rotation of the drill string and actuator sleeve 130 must again be initiated. As illustrated in FIG. 4C, pump 142 is connected through valve 154 to provide fluid in the chamber 124, and rotation of the tubing string and pump 142 will cause piston 122 to move in the reverse direction of arrow A. This movement of piston 122, in turn, moves the valve element 120 to the open position illustrated in FIG. 4D. When piston 122 bottoms out in the reverse direction of arrow A, pressure relief valve 146 will open, supplying fluid pressure to move piston 166 and compress spring 168, as illustrated in FIG. 4D. The valve element 120 will remain in the open position as long as rotation of the drill string continues and will even remain in the open position after rotation ceases.

According, to this embodiment, the actuation means of the present invention moves or shifts the valve element 120 between open and closed by simply starting clockwise rotation of the drill string and then ceasing rotation. The means for maintaining the valve element maintains the valve element in the shifted position until and after rotation ceases, thus eliminating the necessity of precisely counting tubing string rotations.

Therefore, the present invention is well adapted to attain the ends and advantages mentioned as well as those that are inherent therein. The particular embodiments disclosed herein are illustrative only, as the present invention may be modified and practiced in different but equivalent manners apparent to those skilled in the art, having the benefit of the teachings herein. Furthermore, no limitations are intended to the details of construction or design herein shown, other than as described in the claims below. It is, therefore, evident that the particular illustrative embodiments disclosed above may be altered or modified, and all such variations are considered within the scope and spirit of the present invention.

Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of selectively opening and closing a valve positioned at a subterranean location in a wellbore, comprising the steps of:

providing a tubing string;

providing a valve having a valve element movable between an open position and a closed position;

connecting the valve in the tubing string to block and permit flow between the interior and exterior of the tubing string and positioning the valve in the wellbore at a subterranean location;

moving the valve element from the closed position to the open position by rotating the tubing string in the first direction;

after moving the valve to the open position continuing to rotate the tubing string in the first direction while maintaining the valve element in the open position;

after continuing to rotate the tubing string while maintaining the valve in to open position discontinuing rotation of the tubing string while maintaining the valve element in the open position;

moving the valve element from the open position to the closed position by rotating the tubing string in the first direction;

after moving the valve to the closed position continuing to rotate the tubing string in the first direction while maintaining the valve element in the closed position; and after continuing to rotate the tubing string while maintaining the valve in the closed position discontinuing rotation of the tubing string while maintaining the valve element in the closed position.

2. The method of claim 1, wherein the maintaining steps comprising preventing movement of the valve element while rotating the tubing string.

3. The method of claim 1 wherein rotation in the first direction is clockwise rotation.

4. The method of claim 1, wherein the valve comprises a tubular body with a port in the body wall and wherein the step of moving the valve element comprises moving a valve element to open the port.

5. The method of claim 1, wherein the valve comprises a tubular body with a port in the body wall and wherein the step of moving the valve element comprises moving a valve element to block and open the port.

6. The method of claim 5, wherein the steps of moving the valve element between the closed position and open position comprise axially moving the valve element in response to rotation of the tubing string.

7. The method of claim 1, wherein the tubing string additionally comprises spaced packers.

8. The method of claim 7, additionally comprising a step of setting packers to isolate a segment of the wellbore.

9. The method of claim 8, additionally comprising a step of measuring pressure in the isolated segment of the wellbore.

10. The method of claim 1, wherein the steps of moving the valve element between the closed position and open position comprise axially moving the valve element in response to rotation of the tubing string.

* * * * *